US009080831B2

(12) United States Patent
Tseng

(10) Patent No.: US 9,080,831 B2
(45) **Date of Patent: *Jul. 14, 2015**

(54) FIRING DEVICE OF AN AIRSOFT GUN

(71) Applicant: Ying-Jung Tseng, New Taipei (TW)

(72) Inventor: Ying-Jung Tseng, New Taipei (TW)

(73) Assignee: STARJET Technologies Co., LTD, Jintan (CN)

( * ) Notice: Subject to any disclaimer, the term of this patent is extended or adjusted under 35 U.S.C. 154(b) by 114 days.

This patent is subject to a terminal disclaimer.

(21) Appl. No.: 13/947,108

(22) Filed: Jul. 22, 2013

(65) Prior Publication Data

US 2015/0020788 A1 Jan. 22, 2015

(51) Int. Cl.

| | |
|---|---|
| ***F41B 11/62*** | (2013.01) |
| ***F41B 11/51*** | (2013.01) |
| ***F41B 11/723*** | (2013.01) |

(52) U.S. Cl.

CPC ..... *F41B 11/62* (2013.01); *F41B 11/51* (2013.01); *F41B 11/723* (2013.01)

(58) Field of Classification Search

USPC ..... 124/73

See application file for complete search history.

*Primary Examiner* — Reginald Tillman, Jr.

(57) ABSTRACT

A firing device of airsoft gun includes, in combination a butt including a chamber, a passage, a front section, a sleeve member, a port at a front end of the sleeve member, a space in the chamber, a main disc at a rear end of the sleeve member, and a hole in a rear of the sleeve member communicating the sleeve member with the space; a firing mechanism including a sleeve, a stem in the sleeve and having a rear flange member, a disc member in a front of the sleeve, exit ports at the disc member, a flange member at a rear end of the stem, a flange in a rear of the sleeve, and ports in a rear of the stem; a valve; and a high pressure air canister in a rear end of the butt and having a passage communicating with the chamber.

1 Claim, 4 Drawing Sheets

FIRING DEVICE OF AN AIRSOFT GUN

BACKGROUND OF THE INVENTION

1. Field of the Invention

The invention relates to airsoft guns and more particularly to a firing device of an airsoft gun.

2. Description of Related Art

Airsoft guns use an expanding gas, such as compressed air or carbon dioxide ($CO_2$) to propel plastic pellets through the barrel. Airsoft guns can fire in rapid succession a relatively large number of plastic pellets in a short period of time. A magazine stores the plastic pellets until the balls are delivered to the gun firing chamber. The guns use compressed gas as the propellant, and are usually triggered by a user squeezing a conventionally shaped gun trigger. When the gun user repeatedly squeezes the trigger, the gun should continue to fire plastic pellets as rapidly as possible. Airsoft guns most are either semi-automatic, where each time the trigger is pulled a plastic pellet is fired, or fully automatic, where the balls are fired as quickly as the gun is capable of for as long as the trigger is pulled.

Plastic pellets are relatively round and have an exterior formed from a semi-rigid gelatinous compound. The gelatinous compound is known to be affected somewhat by variables such as temperature and relative humidity. During a firing sequence, plastic pellets on occasion lodge against each other or other objects and block the passageway to the firing chamber, resulting in a jam. While jamming is not new, knowledge from explosive munitions magazines is of little use with the very different plastic pellets.

The invention described below aims to minimize jams when using an airsoft gun.

SUMMARY OF THE INVENTION

It is therefore one object of the invention to provide a firing device of an airsoft gun comprising, in combination: a magazine provided with a plurality of plastic pellets; a butt including a chamber, a passage, a front section, a sleeve member, a port at a front end of the sleeve member, an intermediate space in the chamber, a main disc at a rear end of the sleeve member, and a hole in a rear of the sleeve member communicating the sleeve member with the intermediate space; a firing mechanism disposed at a joining portion of the chamber and the magazine and including a sleeve, a stem in the sleeve and having a rear flange member, a disc member in a front of the sleeve and releasably secured to a forward end of the stem, a plurality of exit ports at the disc member, a flange member at a rear end of the stem, a flange in a rear of the sleeve having an area greater than that of the flange member, and a plurality of ports in a rear of the stem; a valve disposed adjacent to the sleeve and communicating with the front section; and a high pressure air canister disposed in a rear end of the butt and including a passage communicating with the chamber and an outlet, the high pressure air canister communicating with the valve via the passage; wherein in a firing operation the valve is opened by pressurized air supplied from the high pressure air canister, the firing mechanism is activated to move rearward to push the sleeve member rearward, the main disc is configured to stop the moving sleeve from moving further rearward, a topmost one of the plastic pellet is pushed to dispose at a front end of the chamber, a forward end of the stem blocks the port, the pressurized air passes the sleeve and flows back to the intermediate space, the valve is closed to stop the pressurized air from flowing to the front section, the pressurized air pushes the firing mechanism forward, the valve is opened by the pressurized air between the flange and the chamber, the firing mechanism moves forward to cause the flange member to block the pressurized air from flowing out of the outlet, the pressurized air in the intermediate space flows through a path between the sleeve member and the stem and further flows through the ports to enter a space between the sleeve and the stem, the pressurized air passes through the port to enter the exit ports, and the pressurized air propels the plastic pellet out of the chamber.

The above and other objects, features and advantages of the invention will become apparent from the following detailed description taken with the accompanying drawings.

DETAILED DESCRIPTION OF THE INVENTION

Figure 1:
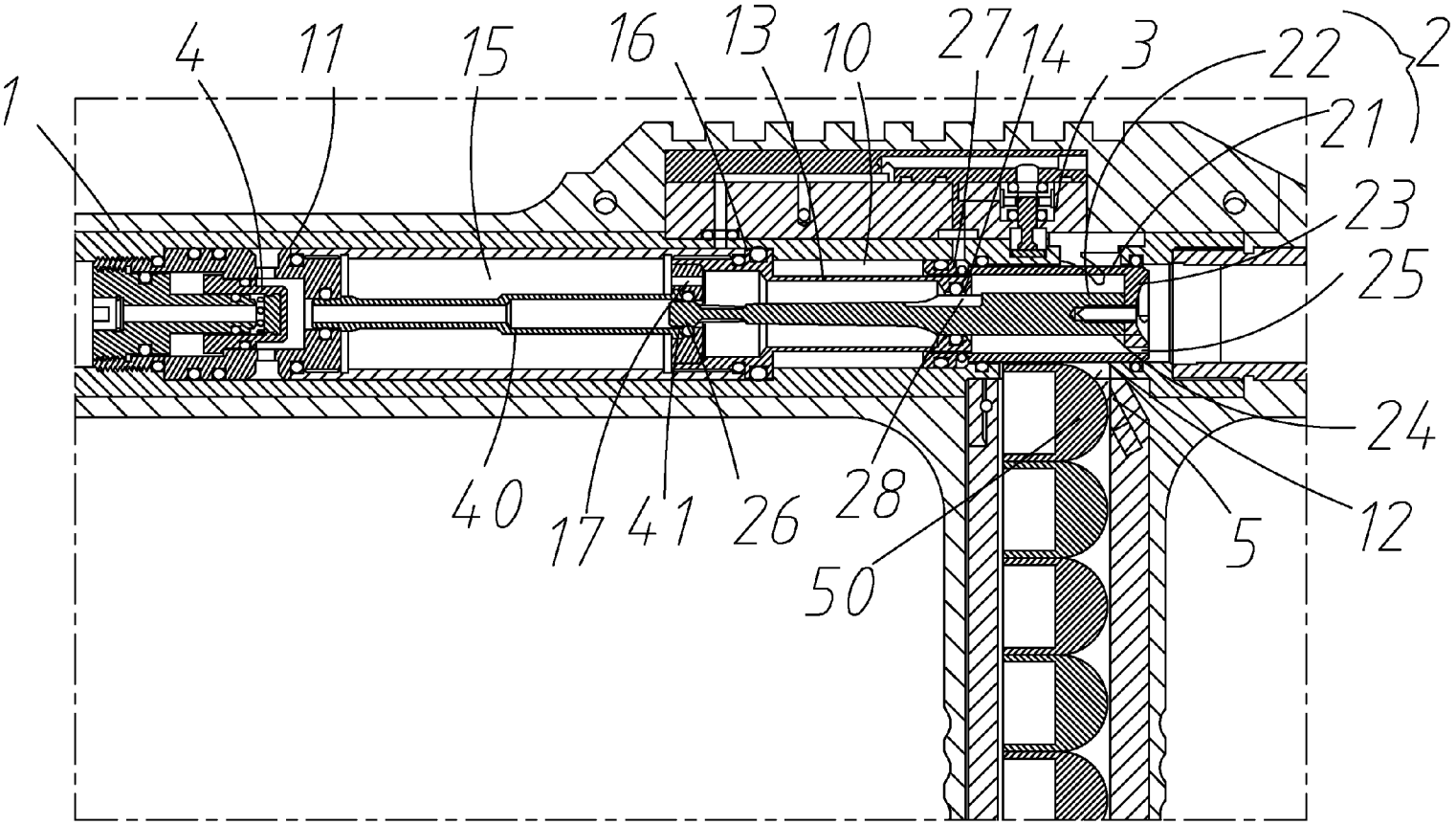
FIG. 1 is a longitudinal sectional view of a butt, a magazine, and a firing mechanism of an airsoft gun incorporating a firing mechanism according to the invention, where pressurized gas has not supplied to the firing mechanism.
Figure 2:
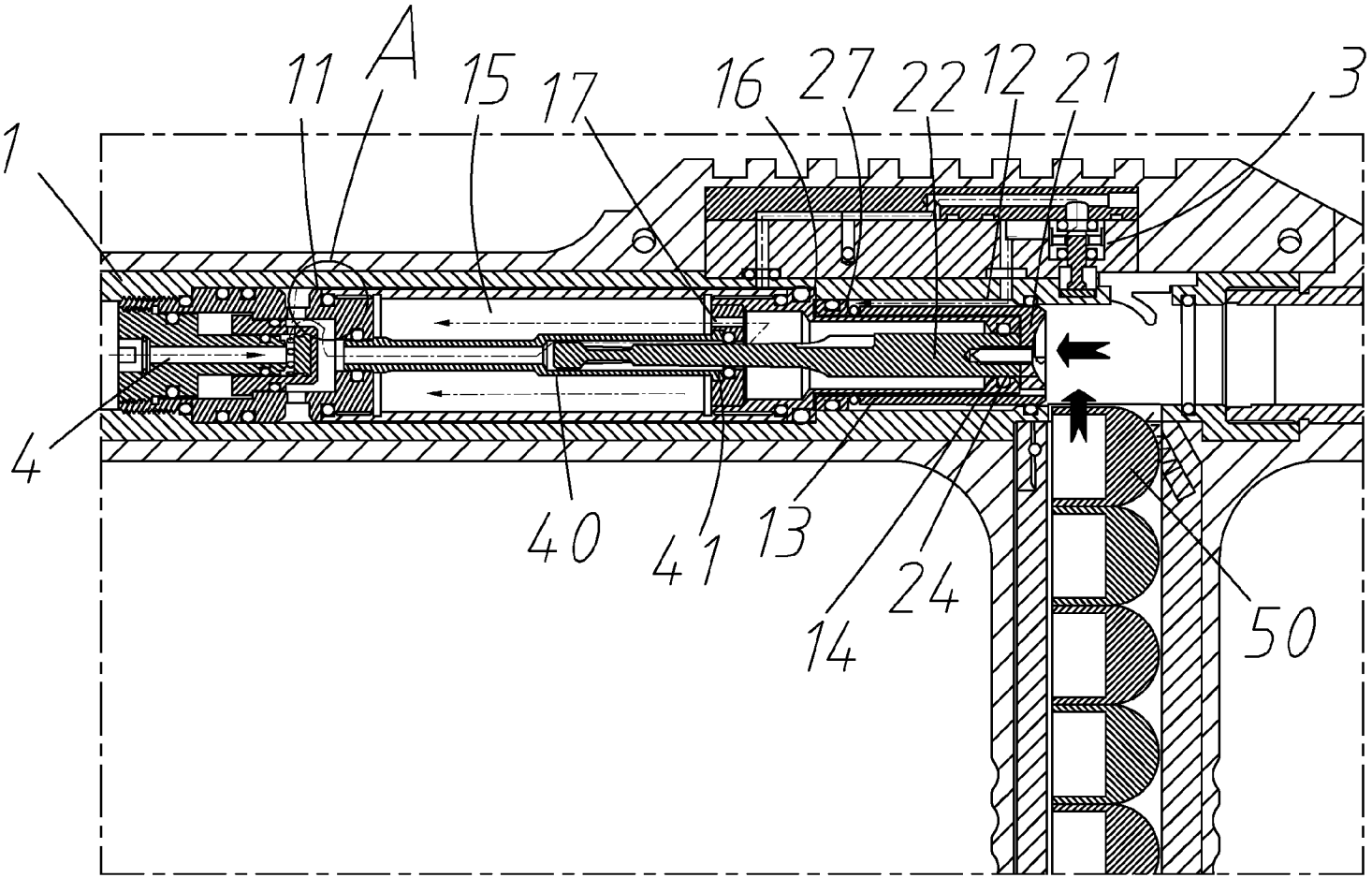
FIG. 2 is a view similar to FIG. 1, where pressurized gas has supplied to the firing mechanism.
Figure 2A:
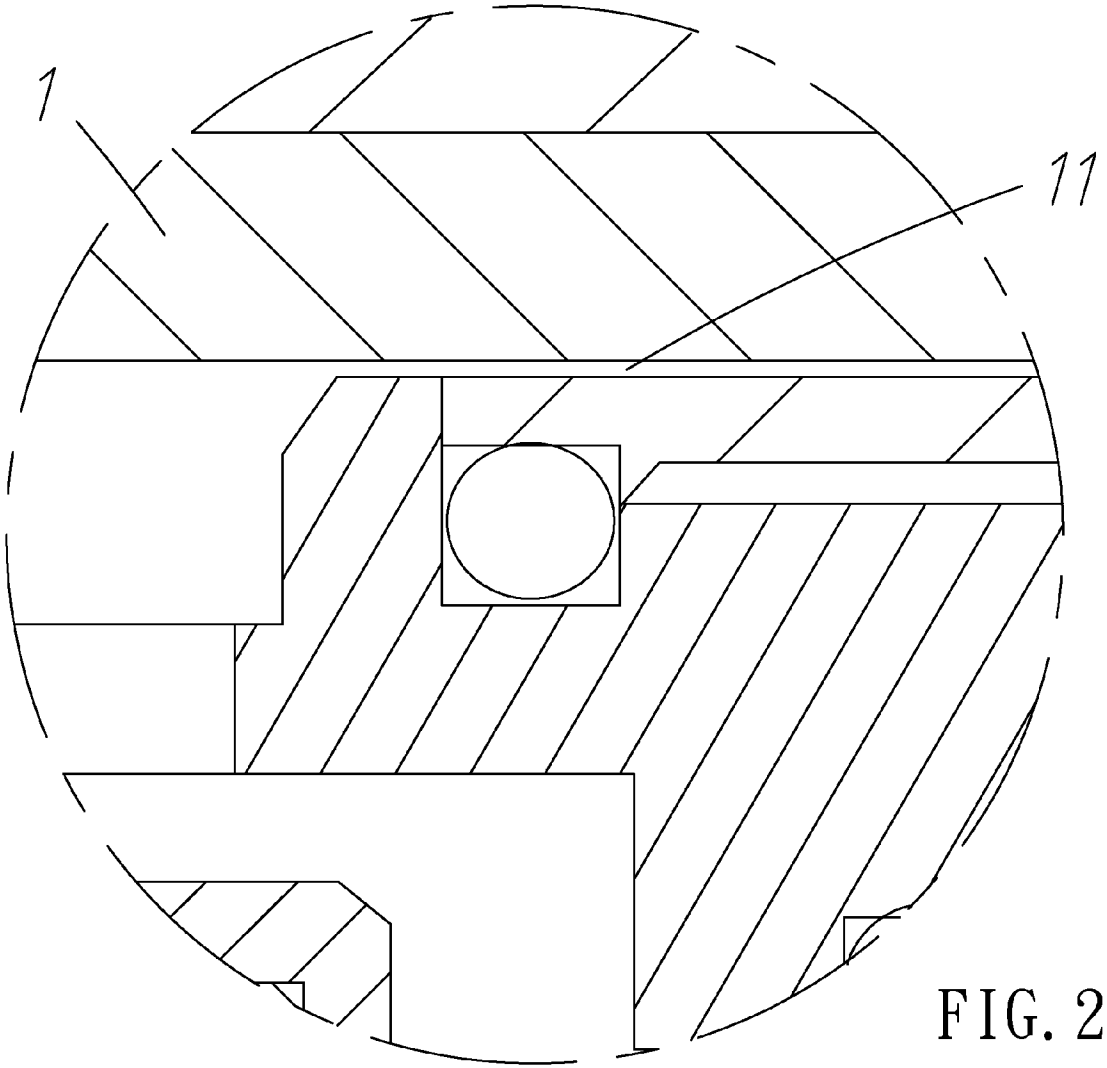
FIG. 2A is an enlarged view of the portion a shown in FIG. 2.
Figure 3:
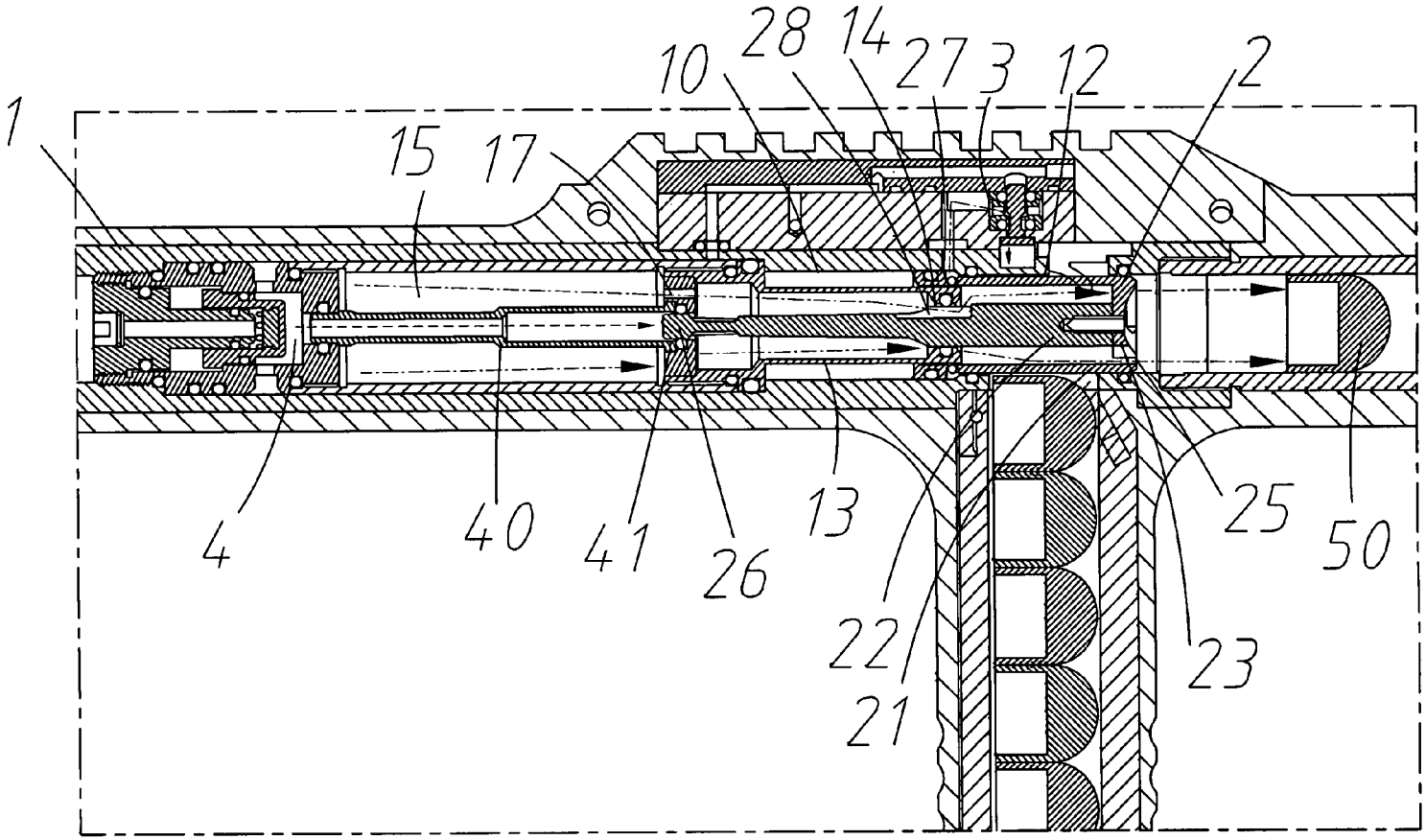
FIG. 3 is a view similar to FIG. 1, where the plastic pellet has been fired.

Referring to FIGS. 1 to 3, an airsoft gun in accordance with the invention comprises the following components as discussed in detail below.

A butt 1 comprises a chamber 10. A firing mechanism 2 is provided at a joining portion of the chamber 10 and a magazine 5 provided with a plurality of plastic pellets 50. The firing mechanism 2 comprises a sleeve 21 and a stem 22 in the sleeve 21. A valve 3 is provided adjacent to the sleeve 21. A high pressure air canister 4 is provided in a rear end of the butt 1. The air canister 4 comprises a passage 40 communicating with the chamber 10. The air canister 4 communicates with the valve 3 via a passage 11 in the butt 1. A front section 12 of the butt 1 communicates with both the magazine 5 and the valve 3.

After activating the air canister 4, the valve 3 is opened by high pressure air supplied from the air canister 4 via the passage 11. Next, the firing mechanism 2 is activated to push a sleeve member 13 in the butt 1 rearward. Area of a cross section of a flange element 27 in a rear of the sleeve 21 is greater than that of a flange member 26 at a rear end of the stem 22. A main disc 16 at a rear end of the sleeve member 13 is adapted to stop the rearward moving sleeve 21 from moving further rearward after moving the firing mechanism 2 rearward. The topmost plastic pellet 50 is then pushed upward to dispose at a front end of the chamber 10 in a ready to fire position. Next, a forward end 24 of the stem 22 blocks a port 14 at a front end of the sleeve member 13. Pressurized air thus flows back to an intermediate space 15 in the chamber 10 after passing a hole 17 in the rear of the sleeve member 13.

An individual may pull a trigger (not shown) to close the valve 3. Next, pressurized air is stopped from flowing to the front section 12. Further, pressurized air is directed to push the firing mechanism 2 forward. The firing mechanism 2 moves forward to cause the flange member 26 to allow pressurized air to flow out of an outlet 41 of the passage 40. Pressurized air in the space 15 flows through a path between the sleeve member 13 and the stem 22 and further flows through a plurality of ports 28 in the rear of the stem 22 to enter a space between the sleeve 21 and the stem 22. And in turn, pressurized air passes through a plurality of exit ports 25 at a front disc 23 of the sleeve 21. The front disc 23 is threadedly secured to the forward end 24 of the stem 22. Further, pressurized air pushes the plastic pellet 50 out of the chamber 10 to fire.

While the invention has been described in terms of preferred embodiments, those skilled in the art will recognize that the invention can be practiced with modifications within the spirit and scope of the appended claims.

What is claimed is:

1. A firing device of an airsoft gun comprising, in combination:

a magazine (5) provided with a plurality of plastic pellets (50);

a butt (1) including a chamber (10), a passage (11), a front section (12), a sleeve member (13), a port (14) at a front end of the sleeve member (13), an intermediate space (15) in the chamber (10), a main disc (16) at a rear end of the sleeve member (13), and a hole (17) in a rear of the sleeve member (13) communicating with the intermediate space (15);

a firing mechanism (2) disposed at a joining portion of the chamber (10) and the magazine (5) and including a sleeve (21), a stem (22) in the sleeve (21) and having a rear flange member (26), a disc member (23) in a front of the sleeve (21) and formed with a forward end (24) of the stem (22), a plurality of exit ports (25) at the disc member (23), a flange element (27) in a rear of the sleeve (21) having an area greater than that of the flange member (26), and a plurality of ports (28) in a rear of the stem (22);

a valve (3) disposed adjacent to the sleeve (21) and communicating with the front section (12); and a high pressure air canister (4) disposed in a rear end of the butt (1) and including a passage (40) communicating with the chamber (10) via an outlet (41), the high pressure air canister (4) communicating with the valve (3) via the passage (11);

wherein in a pressurized air supplying operation, the valve (3) is opened by pressurized air supplied from the high pressure air canister (4) via the passage (11), the firing mechanism (2) is activated by the pressurized air from the valve (3) to move rearward to move the sleeve (21) rearward, the main disc (16) is configured to stop the moving sleeve (21) from moving further rearward, a topmost one of the plastic pellets (50) is pushed to dispose at a front end of the chamber (10), a forward end (24) of the stem (22) blocks the port (14), and the pressurized air passes the hole (17) to flow back to the intermediate space (15); and wherein in a firing operation the valve (3) is closed to stop the pressurized air from flowing to the front section (12), the pressurized air pushes the firing mechanism (2) forward to cause the flange member (26) to allow the pressurized air to flow out of the outlet (41), the pressurized air in the intermediate space (15) flows through a path between the sleeve member (13) and the stem (22) and further flows through the ports (28) to enter a space between the sleeve (21) and the stem (22), the pressurized air passes through the port (14) to enter the exit ports (25), and the pressurized air pushes the plastic pellet (50) at the front end of the chamber (10) out of the chamber (10) to fire.

* * * * *